US012687121B1

(12) United States Patent
Zhang et al.

(10) Patent No.: US 12,687,121 B1
(45) Date of Patent: Jul. 21, 2026

(54) CARBON DIOXIDE ENERGY STORAGE SYSTEM AND CONTROL METHOD THEREOF

(71) Applicant: Exax Energy Technology (Shenzhen) Co., Ltd, Shenzhen (CN)

(72) Inventors: Jie Zhang, Shenzhen (CN); Qin Wang, Shenzhen (CN)

(73) Assignee: Exax Energy Technology (Shenzhen) Co., Ltd, Shenzhen (CN)

( * ) Notice: Subject to any disclaimer, the term of this patent is extended or adjusted under 35 U.S.C. 154(b) by 0 days.

(21) Appl. No.: 19/344,601

(22) Filed: Sep. 30, 2025

(30) Foreign Application Priority Data

Jun. 5, 2025 (CN) ..... 202510743778.X

(51) Int. Cl.
*F01K 25/10* (2006.01)
*F01K 13/02* (2006.01)

(52) U.S. Cl.
CPC ..... *F01K 25/103* (2013.01); *F01K 13/02* (2013.01)

(58) Field of Classification Search
CPC ..... F01K 25/103; F01K 13/02
See application file for complete search history.

(56) References Cited

U.S. PATENT DOCUMENTS 4,765,143 A * 8/1988 Crawford ..... F01K 3/00 60/671
11,643,964 B2 * 5/2023 Spadacini ..... F01K 3/18 60/647
12,259,092 B2 * 3/2025 Katz ..... F02C 6/16
2011/0283702 A1 * 11/2011 Huber ..... F01D 15/10 60/671
2013/0043678 A1 * 2/2013 Saar ..... F02C 1/10 165/45
2016/0281545 A1 * 9/2016 Petrosky ..... F01K 3/06

FOREIGN PATENT DOCUMENTS

CN 111648833 * 9/2020 ..... F01K 11/00

* cited by examiner

*Primary Examiner* — Dustin T Nguyen

(57) ABSTRACT

A carbon dioxide energy storage system and a control method thereof are provided. The system includes a gas storage unit, an energy storage component, a liquid storage unit, an energy release component that are sequentially closed-loop connected, and a gas temporary storage unit connected between the energy storage component and the energy release component. Within a first time period after the energy storage component begins operation and within a second time period before the energy storage component stops operation, the gas temporary storage unit is used to receive and store high temperature carbon dioxide gas output from the energy storage component to obtain stored high-temperature carbon dioxide gas. Before the energy release component begins operation, the gas temporary storage unit is used to replace the low-temperature carbon dioxide gas in an energy release pipeline with the stored high-temperature carbon dioxide gas.

10 Claims, 2 Drawing Sheets

CARBON DIOXIDE ENERGY STORAGE SYSTEM AND CONTROL METHOD THEREOF

CROSS-REFERENCE TO RELATED APPLICATION

This application claims priority to Chinese Patent Application No. 202510743778.X, filed on Jun. 5, 2025, which is herein incorporated by reference in its entirety.

TECHNICAL FIELD

The disclosure relates to the field of energy storage technologies, and more particularly to a carbon dioxide energy storage system and a control method thereof.

BACKGROUND

At present, energy storage technology based on carbon dioxide gas-liquid phase change cycle compresses and condenses gaseous carbon dioxide at normal temperature and pressure in a gas storage unit into liquid carbon dioxide by using excess power or using clean energy in off-peak-electricity hours. The liquid carbon dioxide is stored in the liquid storage unit, and heat energy generated during the compression process is stored. In peak-electricity hours, the stored heat energy is used to heat the liquid carbon dioxide to a gaseous state. The gaseous carbon dioxide drives a turbine to drive a generator to generate electricity, and the gaseous carbon dioxide after doing work is returned to the gas storage unit for recycling. Advantages of simple structure, flexible layout and high energy storage efficiency have gradually attracted widespread attention.

Compressor in an energy storage component is a core component of a carbon dioxide energy storage system. Due to characteristics of the compressor itself, the compressor is prone to surge during start-up and stop-operation stages. In order to avoid the compressor entering the surge condition, in the related art, an anti-surge valve is usually connected at an outlet end of the compressor, and high-temperature carbon dioxide gas output from the compressor during the start-up and stop-operation stages is vented or returned to an inlet end of the compressor through the anti-surge valve. Whether the high-temperature carbon dioxide gas is vented or returned to the inlet end of the compressor, energy of the carbon dioxide energy storage system cannot be effectively utilized, resulting in waste of energy and increasing operating costs.

SUMMARY

An objective of embodiments of the disclosure is to a carbon dioxide energy storage system and a control method thereof to solve a technical problem of how to improve an energy utilization rate of the carbon dioxide energy storage system and reduce operation costs.

In order to achieve the above objective, technical solutions adopted by the disclosure are as follows.

In a first aspect of the disclosure, a carbon dioxide energy storage system is provided, including a gas storage unit, an energy storage component, a liquid storage unit, and an energy release component that are sequentially closed-loop connected. The carbon dioxide energy storage system further includes a gas temporary storage unit connected between the energy storage component and the energy release component. Within a first time period after the energy storage component begins operation and within the second time period before the energy storage component stops operation, the gas temporary storage unit is configured to receive and store high-temperature carbon dioxide gas output from the energy storage component to obtain stored high-temperature carbon dioxide gas. Before the energy release component begins operation, the gas temporary storage unit is configured to input the stored high-temperature carbon dioxide gas into the energy release component, and replace low-temperature carbon dioxide gas in an energy release pipeline in the energy release component with the high-temperature carbon dioxide gas.

In some embodiments, the gas temporary storage unit includes a gas storage container, a first connection pipeline and a second connection pipeline. An inlet of the gas storage container is connected to the energy storage component through the first connection pipeline. An outlet of the gas storage container is connected to the energy release component through the second connection pipeline. A first valve is arranged on the first connection pipeline, and a second valve is arranged on the second connection pipeline.

In some embodiments, the energy storage component includes a compressor and an energy storage heat exchanger. The energy storage heat exchanger is connected to an outlet of the compressor through an energy storage pipeline, and the inlet of the gas storage container is connected to the energy storage pipeline through the first connection pipeline.

In some embodiments, the energy release component includes a turbine and an energy release heat exchanger. The energy release heat exchanger is connected to an inlet of the turbine through the energy release pipeline, and the outlet of the gas storage container is connected to the energy release pipeline through the second connection pipeline.

In some embodiments, the energy release pipeline includes a first inlet, a second inlet, a first outlet and a second outlet. An outlet of the energy release heat exchanger is connected to the first inlet of the energy release pipeline through a third valve. The inlet of the turbine is connected to the first outlet of the energy release pipeline through a fourth valve. The second connection pipeline is connected to the second inlet of the energy release pipeline. The second outlet of the energy release pipeline is connected between the energy storage component and the liquid storage unit through a third connection pipeline. The third connection pipeline is equipped with a fifth valve.

In some embodiments, the first inlet and the second outlet are arranged adjacent to each other at a first end of the energy release pipeline, and the first outlet and the second inlet are arranged adjacent to each other at a second end of the energy release pipeline.

In some embodiments, a condenser is arranged on a connection pipeline between the energy storage component and the liquid storage unit, and the second outlet of the energy release pipeline is connected to the condenser through the third connection pipeline. The low-temperature carbon dioxide gas replaced from the energy release pipeline is output to the liquid storage unit after condensation and liquefaction through the condenser.

In some embodiments, the energy release pipeline is connected to a gas temperature sensor at a position adjacent to the first outlet.

In some embodiments, a connection pipeline between the liquid storage unit and the energy release component is successively provided with a liquid pump and an evaporator.

In a second aspect of the disclosure, a control method of the carbon dioxide energy storage system described above is provided. The control method includes:

S101, controlling, within the first time period after the energy storage component begins operation, the gas temporary storage unit to receive and store the high-temperature carbon dioxide gas output from the energy storage component;

S102, controlling, after the first time period, the gas temporary storage unit to stop receiving the high-temperature carbon dioxide gas output from the energy storage component, thereby transporting the high-temperature carbon dioxide gas to the liquid storage unit;

S103, controlling, within the second time period before the energy storage component stops operation, the gas temporary storage unit to receive and store the high temperature carbon dioxide gas output from the energy storage component until the energy storage component stops operation;

S104, controlling, before the energy release component begins operation, the gas temporary storage unit to input the stored high-temperature carbon dioxide gas into the energy release component, and replacing the low-temperature carbon dioxide gas in the energy release pipeline in the energy release component by the high-temperature carbon dioxide gas; and S105, evaporating and gasifying liquid carbon dioxide stored in the liquid storage unit to obtain gaseous carbon dioxide, inputting the gaseous carbon dioxide to the energy release component, and controlling the energy release component to start operation.

The embodiments of the disclosure provide the carbon dioxide energy storage system and the control method thereof. The carbon dioxide energy storage system includes the gas temporary storage unit connected between the energy storage component and the energy release component. On the one hand, within the first time period after the energy storage component begins operation and within the second time period before the energy storage component stops operation, the high temperature carbon dioxide gas output from the energy storage component is received and stored by the gas temporary storage unit, thereby avoiding the compressor of the energy storage component entering the surge condition and improving the operation stability of the carbon dioxide energy storage system. On the other hand, before the energy release component begins operation, the stored high-temperature carbon dioxide gas is input into the energy release component by the gas temporary storage unit, and the low-temperature carbon dioxide gas in the energy release pipeline of the energy release component is replaced by the high-temperature carbon dioxide gas. The high-temperature carbon dioxide gas that originally needs to be vented or refluxed to avoid surge is applied to the energy release component, which can not only avoid wasting energy and improve the energy utilization rate of the system to reduce the operating cost, but also replace the low-temperature carbon dioxide gas in the energy release pipeline with the high-temperature carbon dioxide gas, which creates favorable conditions for the rapid start-up of the energy release condition, and improves the operating efficiency of the system.

DETAILED DESCRIPTION OF EMBODIMENTS

Figure 1:
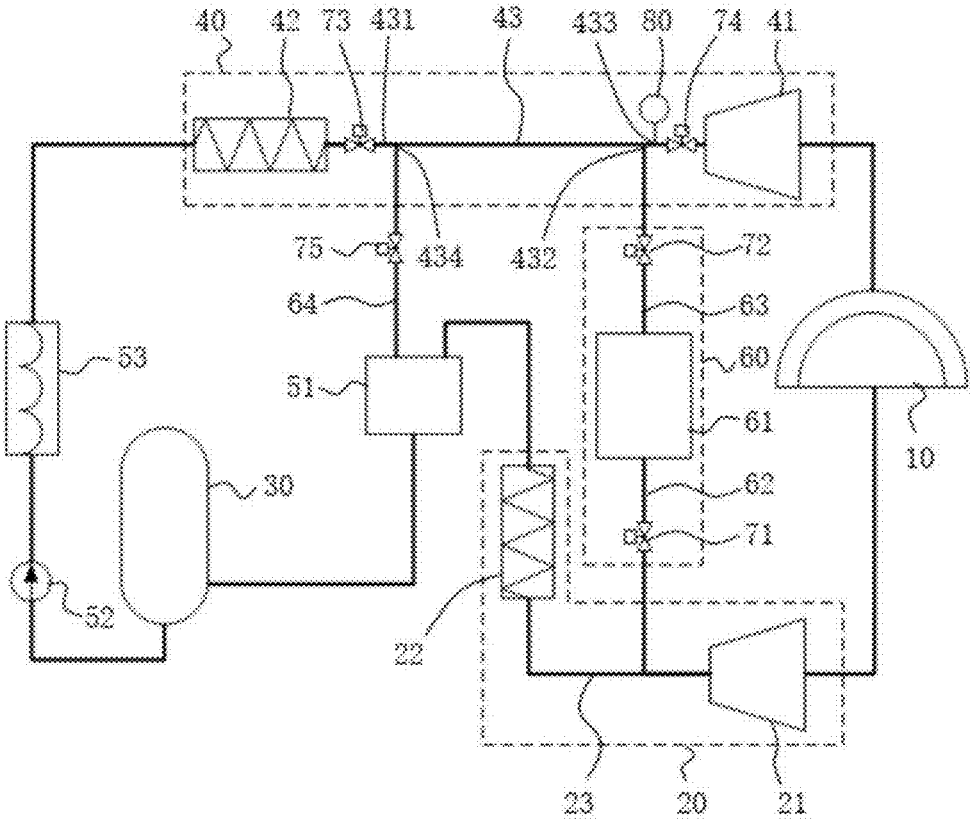
FIG. 1 illustrates a schematic structure diagram of a carbon dioxide energy storage system according to an embodiment of the disclosure.

In order to make objectives, technical solutions and beneficial effects of the disclosure more clearly understood, specific embodiments of the disclosure are described in detail below in conjunction with drawings. These exemplary embodiments are illustrated in the drawings. The embodiments shown in the drawings and described based on the drawings are merely illustrative, and the disclosure is not limited to these embodiments.

It should be noted that in the drawings of the embodiments of the disclosure, identical or similar reference numerals correspond to identical or similar components. In the description of the disclosure, it should be understood that an orientation or position relationship indicated by terms such as "up", "down", "left" and "right" are based on the orientation or position relationship shown in the drawings, and are only for the convenience of describing the disclosure and simplifying the description, and do not indicate or imply that the device or element referred to must have a specific orientation, be constructed and operated in a specific orientation. Therefore, the terms used to describe the position relationship in the drawings are only for illustrative purposes and should not be construed as a limitation on the disclosure. For those skilled in the art, the specific meanings of the terms can be understood according to specific circumstances.

In addition, it should also be noted that in order to avoid obscuring the disclosure due to unnecessary details, only structures and/or processing steps closely related to the scheme of the disclosure are shown in the drawings, and other details not related to the disclosure are omitted.

An embodiment of the disclosure provides a carbon dioxide energy storage system, as shown in FIG. 1, the carbon dioxide energy storage system mainly includes a gas storage unit 10, an energy storage component 20, a liquid storage unit 30 and an energy release component 40 that are sequentially closed-loop connected. The gas storage unit 10 is used to store gaseous carbon dioxide at atmospheric pressure, and the liquid storage unit 30 is used to store liquid carbon dioxide. The gaseous carbon dioxide flowing out from the gas storage unit 10 is converted into the liquid carbon dioxide with a preset energy storage pressure through the energy storage component 20, and the liquid carbon dioxide flows into the liquid storage unit 30 to complete the energy storage in the process. The liquid carbon dioxide output from the liquid storage unit 30 is converted into the gaseous carbon dioxide at atmospheric pressure through the energy release component 40, which flows into the gas storage unit 10, and the energy release and application are completed in this process. Usually, the energy storage component 20 compresses and liquefies the gaseous carbon dioxide into the liquid carbon dioxide and stores the liquid carbon dioxide in the liquid storage unit 30 during off-peak-electricity hours or by using wind and solar power curtailment to store the energy conversion compression energy and heat energy. During peak-electricity hours, the liquid carbon dioxide is vaporized and expanded by the energy release component 40 to release the stored energy and convert the stored energy into electric energy.

The specific composition structures of the gas storage unit 10, the energy storage component 20, the liquid storage unit 30 and the energy release component 40 can be realized by referring to the related art. The gas storage unit 10 is also known in the related art as a gas storage vessel, a gas storage reservoir, a gas storage component, etc. The liquid storage unit 30 is also known in the related art as a liquid storage tank, a liquid storage container, an energy storage container. For example, the specific composition structures are as disclosed in technical solutions of the following patent documents: CN119289275A, CN116221616A, CN117628836A, and CN116857027A.

As a specific case, in this embodiment, as shown in FIG. 1, the energy storage component 20 mainly includes a compressor 21 and an energy storage heat exchanger 22 connected between the gas storage unit 10 and the liquid storage unit 30. The energy storage heat exchanger 22 is connected to an outlet of the compressor 21 through an energy storage pipeline 23. Furthermore, a condenser 51 is arranged on a connection pipeline between the energy storage component 20 and the liquid storage unit 30. The gaseous carbon dioxide in the gas storage unit 10 is compressed by the compressor 21, cooled by the heat exchange of the energy storage heat exchanger 22, and then liquefied by the condenser 51 to the liquid carbon dioxide stored in the liquid storage unit 30.

As a specific case, in this embodiment, as shown in FIG. 1, the energy release component 40 mainly includes an energy release heat exchanger 42 and a turbine 41 connected between the liquid storage unit 30 and the gas storage unit 10. The energy release heat exchanger 42 is connected to an inlet of the turbine 41 through an energy release pipe 43. Further, a liquid pump 52 and an evaporator 53 are sequentially arranged on a connection pipeline between the liquid storage unit 30 and the energy release component 40. The liquid carbon dioxide in the liquid storage unit 30 is pressurized by the liquid pump 52 and input to the evaporator 53 to obtain pressurized liquid carbon dioxide. After the pressurized liquid carbon dioxide is heated and evaporated by the evaporator 53, it is input to the energy release heat exchanger 42 for further heating to increase the temperature, and then input to the turbine 41 for external work (such as power generation) to release energy, which is converted into the gaseous carbon dioxide at atmospheric pressure stored in the gas storage unit 10.

The compressor 21 of the energy storage component 20 is the core component of the carbon dioxide energy storage system. During the energy storage process: when the compressor 21 begins operation, it is necessary to gradually increase the air intake at an inlet of the compressor 21, and the gas pressure at the outlet of the compressor 21 is also gradually increased; when the compressor 21 is scheduled to stop operation, it is necessary to gradually reduce the air intake of the inlet of the compressor 21, and the gas pressure of the outlet of the compressor 21 is also gradually reduced. Since the liquid storage unit 30 itself and the pipeline connected to an energy storage side of an inlet of the liquid storage unit 30 have a certain pressure, when the gas pressure at the outlet of the compressor 21 does not exceed the pressure of the liquid storage unit 30, the carbon dioxide gas output by the compressor 21 cannot be transported to the liquid storage unit 30. Therefore, the compressor 21 is prone to surge during the start-up and stop-operation stages. In the related art, in order to avoid the compressor entering the surge condition, an anti-surge valve is usually connected to the outlet of the compressor, and the high-temperature carbon dioxide gas output by the compressor in the start-up and stop-operation stages is vented or returned to the inlet of the compressor through the anti-surge valve. Whether the high-temperature carbon dioxide gas is vented or returned to the inlet of the compressor, the energy of the carbon dioxide energy storage system cannot be effectively utilized, resulting in waste of energy and increasing operating costs.

In order to solve the above problems, the carbon dioxide energy storage system is provided in the embodiment of the disclosure. As shown in FIG. 1, the carbon dioxide energy storage system further includes a gas temporary storage unit 60. The gas temporary storage unit 60 is connected between the energy storage component 20 and the energy release component 40. The gas temporary storage unit 60 is configured to receive and store the high-temperature carbon dioxide gas output from the energy storage component 20 within the first time period after the energy storage component 20 starts operation and within the second time period before the energy storage component 20 stops operation. Thus, the compressor 21 in the energy storage component 20 avoids entering the surge condition, and the stability of the carbon dioxide energy storage system is improved. Before the energy release component 40 starts operation, the gas temporary storage unit 60 inputs the stored high-temperature carbon dioxide gas into the energy release component 40, and replaces the low-temperature carbon dioxide gas in the energy release pipeline 43 in the energy release component 40 with the high-temperature carbon dioxide gas. Therefore, the high-temperature carbon dioxide gas that originally needs to be vented or refluxed to avoid surge is applied to the energy release component 40, which can not only avoid wasting energy and improve the energy utilization rate of the system to reduce operating costs, but also replace the low-temperature carbon dioxide gas in the energy release pipeline 43 with the high-temperature carbon dioxide gas. It creates favorable conditions for the rapid start-up of energy release conditions and improves the operating efficiency of the system.

It should be noted that the specific duration of the first and second time periods needs to be specifically set according to the actual operating conditions of the energy storage component 20 to meet the basic requirements of avoiding the compressor 21 from entering the surge condition.

In a specific embodiment, as shown in FIG. 1, the gas temporary storage unit 60 mainly comprises a gas storage container 61, a first connection pipeline 62 and a second connection pipeline 63. An inlet of the gas storage container 61 is connected to the energy storage component 20 through the first connection pipeline 62, specifically connected to the energy storage pipeline 23. An outlet of the gas storage container 61 is connected to the energy release component 40 through the second connection pipeline 63, specifically connected to the energy release pipeline 43. A first valve 71 is arranged on the first connection pipeline 62, and a second valve 72 is arranged on the second connection pipeline 63. By controlling opening and closing states of the first valve 71 and the second valve 72, the gas temporary storage unit 60 receives the high temperature carbon dioxide gas or outputs the high temperature carbon dioxide gas.

Specifically, within the first time period after the energy storage component 20 starts operation and within the second time period before the energy storage component 20 stops operation, the first valve 71 is opened and the second valve 72 is closed, and the high temperature carbon dioxide gas output from the compressor 21 is input into the gas storage container 61 for storage. Before the energy release component 40 starts operation, the first valve 71 is closed and the second valve 72 is opened. The high-temperature carbon dioxide gas stored in the gas storage container 61 is input into the energy release pipeline 43, and the low-temperature carbon dioxide gas in the energy release pipeline 43 is replaced with the high-temperature carbon dioxide gas.

In some embodiments, as shown in FIG. 1, the energy release pipeline 43 includes a first inlet 431, a second inlet 432, a first outlet 433, and a second outlet 434. An outlet of the energy release heat exchanger 42 is connected to the first inlet 431 of the energy release pipeline 43 through a third valve 73. The inlet of the turbine 41 is connected to the first outlet 433 of the energy release pipeline 43 through a fourth valve 74. The second connection pipeline 63 is connected to the second inlet 432 of the energy release pipeline 43. The second outlet 434 of the energy release pipeline 43 is connected between the energy storage component 20 and the liquid storage unit 30 through a third connection pipeline 64, and the third connection pipeline 64 is equipped with a fifth valve 75.

Before the energy release component 40 starts operation, the second valve 72 and the fifth valve 75 are opened, and the third valve 73 and the fourth valve 74 are closed. At this time, the high-temperature carbon dioxide gas stored in the gas storage container 61 is input from the second inlet 432 to the energy release pipeline 43, and the low-temperature carbon dioxide gas in the energy release pipeline 43 is output from the second outlet 434, and is transported to the liquid storage unit 30 through the third connection pipeline 64. After the low-temperature carbon dioxide gas in the energy release pipeline 43 is completely replaced, the second valve 72 and the fifth valve 75 are closed, and the third valve 73 and the fourth valve 74 are opened. After the energy release component 40 starts operation, the high-temperature carbon dioxide gas output by the energy release heat exchanger 42 is input from the first inlet 431 of the energy release pipeline 43, and then output to the turbine 41 through the first outlet 433.

In the embodiment, the first inlet 431 and the second outlet 434 are arranged adjacent to each other at a first end of the energy release pipeline 43, and the first outlet 433 and the second inlet 432 are arranged adjacent to each other at a second end of the energy release pipeline 43. Furthermore, the energy release tube 43 is connected to a gas temperature sensor 80 at a position adjacent to the first outlet 433. The gas temperature sensor 80 is used to detect the temperature of carbon dioxide gas in the energy release pipeline 43. On the one hand, it can monitor whether the low-temperature carbon dioxide gas in the energy release pipeline 43 can be completely replaced to reach a preset higher temperature. On the other hand, the gas temperature at the inlet of the turbine 41 is monitored during the operation of the energy release component 40.

In some embodiments, the second outlet 434 of the energy releasing pipe 43 is connected to the condenser 51 through the third connection pipeline 64. Therefore, the low-temperature carbon dioxide gas replaced from the energy release pipeline 43 is condensed and liquefied through the condenser 51 and output to the liquid storage unit 30.

Figure 2:
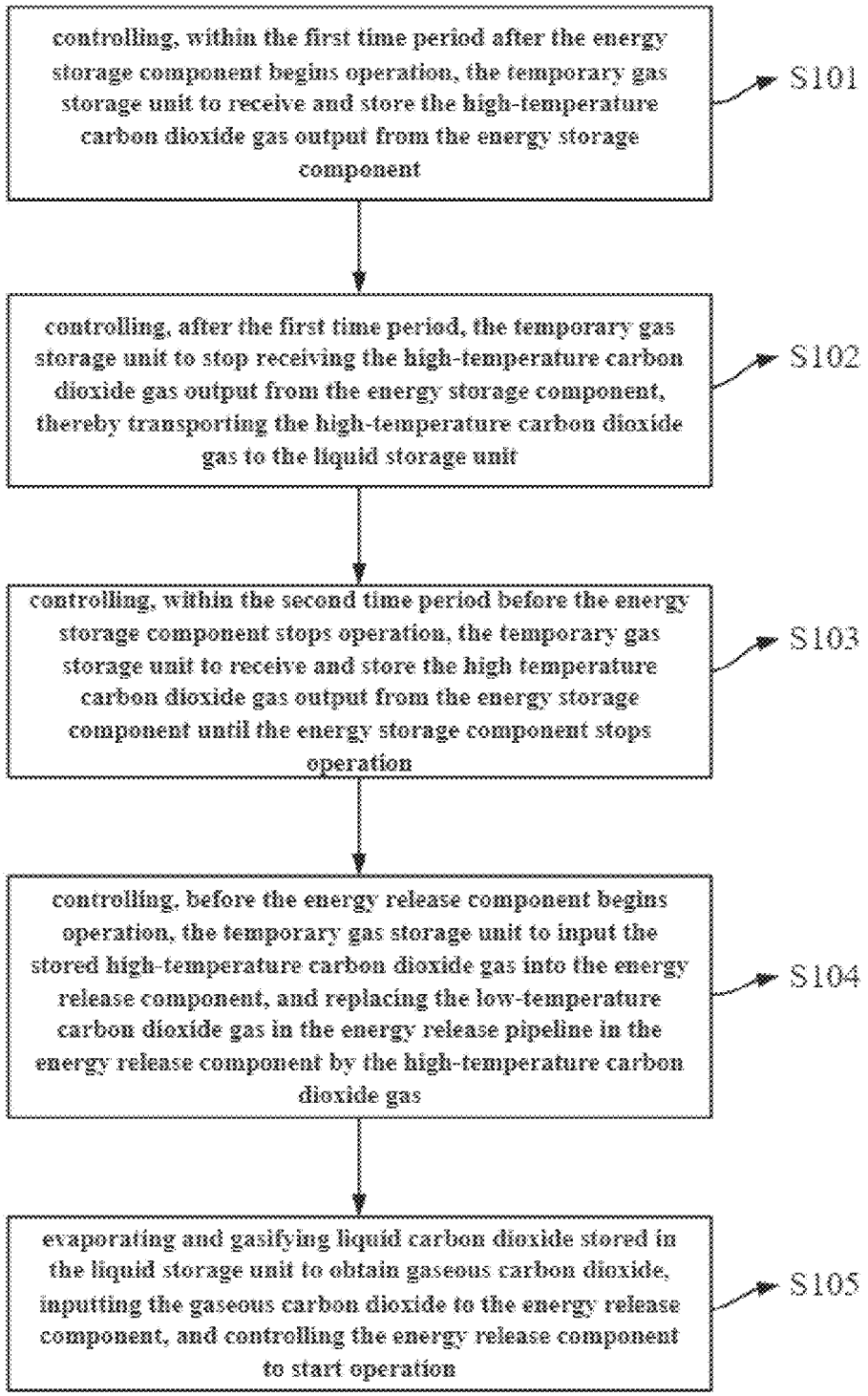
FIG. 2 illustrates a schematic flowchart of a control method of the carbon dioxide energy storage system according to an embodiment of the disclosure.

Based on the carbon dioxide energy storage system provided by the above embodiment, another embodiment of the disclosure provides a control method of the carbon dioxide energy storage system. As shown in FIG. 2, the control method includes step S101 through step S105 as follows.

S101, within the first time period after the energy storage component 20 begins operation, the gas temporary storage unit 60 is controlled to receive and store the high-temperature carbon dioxide gas output from the energy storage component 20.

Specifically, within the first time period after the energy storage component 20 begins operation, the first valve 71 is opened and the second valve 72 is closed, so that the high-temperature carbon dioxide gas output by the compressor 21 is input into the gas storage container 61 for storage.

S102, after the first time period, the gas temporary storage unit 60 is controlled to stop receiving the high-temperature carbon dioxide gas output from the energy storage component 20, so that the high-temperature carbon dioxide gas is transported to the liquid storage unit 30.

Specifically, after the first time period, the energy storage component 20 enters a stable operating state, and the first valve 71 is closed. The high-temperature carbon dioxide gas output by the compressor 21 is no longer input to the gas storage container 61. The high-temperature carbon dioxide gas output by the compressor 21 is input to the energy storage heat exchanger 22 for heat exchange and cooling, and then liquefied by the condenser 51 to form liquid carbon dioxide stored in the liquid storage unit 30.

S103, within the second time period before the energy storage component 20 stops operation, the gas temporary storage unit 60 is controlled to receive and store the high temperature carbon dioxide gas output from the energy storage component 20 until the energy storage component 20 stops operation.

Specifically, within the second time period before the energy storage component 20 stops operation, the first valve 71 is opened again. At this time, the second valve 72 remains closed, and the high-temperature carbon dioxide gas output by the compressor 21 is input into the gas storage container 61 for storage until the compressor 21 completely stops operation and closes the first valve 71.

S104, before the energy release component 40 begins operation, the gas temporary storage unit 60 is controlled to input the stored high-temperature carbon dioxide gas into the energy release component 40, and the low-temperature carbon dioxide gas in the energy release pipeline 43 in the energy release component 40 is replaced by the high-temperature carbon dioxide gas.

Specifically, before the energy release component 40 begins operation, the first valve 71 is kept closed, the second valve 72 and the fifth valve 75 are opened, and the third valve 73 and the fourth valve 74 are closed. At this time, the high-temperature carbon dioxide gas stored in the gas storage container 61 is input to the energy release pipeline 43, and the low-temperature carbon dioxide gas in the energy release pipeline 43 is output through the third connection pipeline 64, thereby replacing the low-temperature carbon dioxide gas in the energy release pipeline 43 with the high-temperature carbon dioxide gas.

Further, in the process of replacement, the temperature of the carbon dioxide gas in the energy release pipeline 43 is detected by the gas temperature sensor 80. When the detected temperature reaches the preset temperature (i.e., the preset higher temperature), it is determined that the low temperature carbon dioxide gas in the energy release pipeline 43 is completely replaced. At this time, the second valve 72 and the fifth valve 75 are closed, and the third valve 73 and the fourth valve 74 are opened.

S105, the liquid carbon dioxide stored in the liquid storage unit 30 is evaporated and gasified and input to the energy release component 40, and the energy release component 40 is controlled to start operation.

Specifically, the third valve 73 and the fourth valve 74 are kept open, and the second valve 72 and the fifth valve 75 are kept closed. The liquid carbon dioxide in the liquid storage unit 30 is pressurized by the liquid pump 52 and input to the evaporator 53, which is heated and evaporated by the evaporator 53 and then input to the energy release heat exchanger 42. At this time, the turbine 41 is controlled to start operation, and the high temperature carbon dioxide gas output by the energy release heat exchanger 42 is input to the turbine 41, which is powered by the turbine 41. The converted gaseous carbon dioxide at atmospheric pressure is stored in the gas storage unit 10.

In summary, the carbon dioxide energy storage system and the control method thereof are provided in the above embodiments of the disclosure. The gas temporary storage unit is set between the energy storage component and the energy release component. On the one hand, within the first time period after the energy storage component begins operation and within the second time period before the energy storage component stops operation, the gas temporary storage unit is configured to receive and store the high-temperature carbon dioxide gas output from the energy storage component to obtain stored high-temperature carbon dioxide gas, thereby avoiding the compressor of the energy storage component entering the surge condition and improving the operation stability of the energy storage system operation. On the other hand, before the energy release component begins operation, the gas temporary storage unit is configured to input the stored high-temperature carbon dioxide gas into the energy release component, and replace low-temperature carbon dioxide gas in an energy release pipeline in the energy release component with the high-temperature carbon dioxide gas. The high-temperature carbon dioxide gas that originally needs to be vented or refluxed to avoid surge is applied to the energy release component, which can not only avoid wasting energy and improve the energy utilization rate of the system to reduce the operating cost, but also replace the low-temperature carbon dioxide gas in the energy release pipeline with high-temperature carbon dioxide gas, which creates favorable conditions for the rapid start-up of the energy release condition, and improves the operating efficiency of the system.

The above description is merely some of the embodiments of the disclosure. It should be pointed out that for those skilled in the related art, some improvements and embellishments can be made without deviating from the principle of the disclosure. Any improvements and embellishments made within the spirit and principles of the disclosure shall be included in the protection scope of the disclosure.

What is claimed is:

1. A carbon dioxide energy storage system, comprising: a gas storage unit, an energy storage component, a liquid storage unit and an energy release component sequentially closed-loop connected; wherein the carbon dioxide energy storage system further comprises a gas temporary storage unit connected between the energy storage component and the energy release component; the gas temporary storage unit comprises a gas storage container, a first connection pipeline and a second connection pipeline; the energy storage component comprises a compressor and an energy storage heat exchanger; the energy storage heat exchanger is connected to an outlet of the compressor through an energy storage pipeline; the energy release component comprises a turbine and an energy release heat exchanger; the energy release heat exchanger is connected to an inlet of the turbine through an energy release pipeline; an inlet of the gas storage container is connected to the energy storage pipeline through the first connection pipeline; an outlet of the gas storage container is connected to the energy release pipeline through the second connection pipeline; a first valve is arranged on the first connection pipeline, and a second valve is arranged on the second connection pipeline;

wherein the energy release pipeline comprises a first inlet, a second inlet, a first outlet and a second outlet; an outlet of the energy release heat exchanger is connected to the first inlet of the energy release pipeline through a third valve; the inlet of the turbine is connected to the first outlet of the energy release pipeline through a fourth valve; the second connection pipeline is connected to the second inlet of the energy release pipe; the second outlet of the energy release pipeline is connected between the energy storage component and the liquid storage unit through a third connection pipeline; and the third connection pipeline is equipped with a fifth valve; and wherein the gas temporary storage unit is configured as follows:

within a first time period after the energy storage component begins operation and within a second time period before the energy storage component stops operation, the gas temporary storage unit is configured to receive and store high-temperature carbon dioxide gas output from the energy storage component to obtain stored high-temperature carbon dioxide gas; and before the energy release component begins operation, the gas temporary storage unit is configured to input the stored high-temperature carbon dioxide gas into the energy release component, and replace low-temperature carbon dioxide gas in the energy release pipeline in the energy release component with the high-temperature carbon dioxide gas.

2. The carbon dioxide energy storage system as claimed in claim 1, wherein the first inlet and the second outlet are arranged adjacent to each other at a first end of the energy release pipeline, and the first outlet and the second inlet are arranged adjacent to each other at a second end of the energy release pipeline.

3. A control method of the carbon dioxide energy storage system as claimed in claim 2, wherein the control method comprises:

controlling, within the first time period after the energy storage component begins operation, the gas temporary storage unit to receive and store the high-temperature carbon dioxide gas output from the energy storage component;

controlling, after the first time period, the gas temporary storage unit to stop receiving the high-temperature carbon dioxide gas output from the energy storage component, thereby transporting the high-temperature carbon dioxide gas to the liquid storage unit;

controlling, within the second time period before the energy storage component stops operation, the gas temporary storage unit to receive and store the high temperature carbon dioxide gas output from the energy storage component until the energy storage component stops operation;

controlling, before the energy release component begins operation, the gas temporary storage unit to input the stored high-temperature carbon dioxide gas into the energy release component, and replacing the low-temperature carbon dioxide gas in the energy release pipeline in the energy release component by the high-temperature carbon dioxide gas; and evaporating and gasifying liquid carbon dioxide stored in the liquid storage unit to obtain gaseous carbon dioxide, inputting the gaseous carbon dioxide to the energy release component, and controlling the energy release component to start operation.

4. The carbon dioxide energy storage system as claimed in claim 1, wherein a condenser is arranged on a connection pipeline between the energy storage component and the liquid storage unit, and the second outlet of the energy release pipeline is connected to the condenser through the third connection pipeline; the low-temperature carbon dioxide gas replaced from the energy release pipeline is output to the liquid storage unit after condensation and liquefaction through the condenser.

5. A control method of the carbon dioxide energy storage system as claimed in claim 4, wherein the control method comprises:

controlling, within the first time period after the energy storage component begins operation, the gas temporary storage unit to receive and store the high-temperature carbon dioxide gas output from the energy storage component;

controlling, after the first time period, the gas temporary storage unit to stop receiving the high-temperature carbon dioxide gas output from the energy storage component, thereby transporting the high-temperature carbon dioxide gas to the liquid storage unit;

controlling, within the second time period before the energy storage component stops operation, the gas temporary storage unit to receive and store the high temperature carbon dioxide gas output from the energy storage component until the energy storage component stops operation;

controlling, before the energy release component begins operation, the gas temporary storage unit to input the stored high-temperature carbon dioxide gas into the energy release component, and replacing the low-temperature carbon dioxide gas in the energy release pipeline in the energy release component by the high-temperature carbon dioxide gas; and evaporating and gasifying liquid carbon dioxide stored in the liquid storage unit to obtain gaseous carbon dioxide, inputting the gaseous carbon dioxide to the energy release component, and controlling the energy release component to start operation.

6. The carbon dioxide energy storage system as claimed in claim 1, wherein the energy release pipeline is connected to a gas temperature sensor at a position adjacent to the first outlet.

7. A control method of the carbon dioxide energy storage system as claimed in claim 6, wherein the control method comprises:

controlling, within the first time period after the energy storage component begins operation, the gas temporary storage unit to receive and store the high-temperature carbon dioxide gas output from the energy storage component;

controlling, after the first time period, the gas temporary storage unit to stop receiving the high-temperature carbon dioxide gas output from the energy storage component, thereby transporting the high-temperature carbon dioxide gas to the liquid storage unit;

controlling, within the second time period before the energy storage component stops operation, the gas temporary storage unit to receive and store the high temperature carbon dioxide gas output from the energy storage component until the energy storage component stops operation;

controlling, before the energy release component begins operation, the gas temporary storage unit to input the stored high-temperature carbon dioxide gas into the energy release component, and replacing the low-temperature carbon dioxide gas in the energy release pipeline in the energy release component by the high-temperature carbon dioxide gas; and evaporating and gasifying liquid carbon dioxide stored in the liquid storage unit to obtain gaseous carbon dioxide, inputting the gaseous carbon dioxide to the energy release component, and controlling the energy release component to start operation.

8. The carbon dioxide energy storage system as claimed in claim 1, wherein a connection pipeline between the liquid storage unit and the energy release component is successively provided with a liquid pump and an evaporator.

9. A control method of the carbon dioxide energy storage system as claimed in claim 8, wherein the control method comprises:

controlling, within the first time period after the energy storage component begins operation, the gas temporary storage unit to receive and store the high-temperature carbon dioxide gas output from the energy storage component;

controlling, after the first time period, the gas temporary storage unit to stop receiving the high-temperature carbon dioxide gas output from the energy storage component, thereby transporting the high-temperature carbon dioxide gas to the liquid storage unit;

controlling, within the second time period before the energy storage component stops operation, the gas temporary storage unit to receive and store the high temperature carbon dioxide gas output from the energy storage component until the energy storage component stops operation;

controlling, before the energy release component begins operation, the gas temporary storage unit to input the stored high-temperature carbon dioxide gas into the energy release component, and replacing the low-temperature carbon dioxide gas in the energy release pipeline in the energy release component by the high-temperature carbon dioxide gas; and evaporating and gasifying liquid carbon dioxide stored in the liquid storage unit to obtain gaseous carbon dioxide, inputting the gaseous carbon dioxide to the energy release component, and controlling the energy release component to start operation.

10. A control method of the carbon dioxide energy storage system as claimed in claim 1, wherein the control method comprises:

controlling, within the first time period after the energy storage component begins operation, the gas temporary storage unit to receive and store the high-temperature carbon dioxide gas output from the energy storage component;

controlling, after the first time period, the gas temporary storage unit to stop receiving the high-temperature carbon dioxide gas output from the energy storage component, thereby transporting the high-temperature carbon dioxide gas to the liquid storage unit;

controlling, within the second time period before the energy storage component stops operation, the gas temporary storage unit to receive and store the high temperature carbon dioxide gas output from the energy storage component until the energy storage component stops operation;

controlling, before the energy release component begins operation, the gas temporary storage unit to input the stored high-temperature carbon dioxide gas into the energy release component, and replacing the low-temperature carbon dioxide gas in the energy release pipeline in the energy release component by the high-temperature carbon dioxide gas; and evaporating and gasifying liquid carbon dioxide stored in the liquid storage unit to obtain gaseous carbon dioxide, inputting the gaseous carbon dioxide to the energy release component, and controlling the energy release component to start operation.

* * * * *